US005180137A

United States Patent [19]

Carlson et al.

[11] Patent Number: 5,180,137

[45] Date of Patent: Jan. 19, 1993

[54] RAM TYPE BLOWOUT PREVENTER HAVING IMPROVED RAM FRONT PACKINGS

[75] Inventors: Douglas W. Carlson; Stephen P. Simons, both of Kingwood, Tex.

[73] Assignee: Hydril Company, Houston, Tex.

[21] Appl. No.: 770,181

[22] Filed: Oct. 2, 1991

[51] Int. Cl.[5] ..... E21B 33/06

[52] U.S. Cl. ..... 251/1.3; 277/188 A

[58] Field of Search ..... 251/1.1, 1.3; 277/129, 277/188 A

[56] References Cited

U.S. PATENT DOCUMENTS

| | | | |
|---|---|---|---|
| 4,219,204 | 8/1980 | Pippert | 277/188 A |
| 4,553,730 | 11/1985 | Vicic | 251/1.3 |
| 5,005,802 | 4/1991 | McWharter et al. | 251/1.3 |

*Primary Examiner*—John C. Fox

*Attorney, Agent, or Firm*—Vaden, Eickenroht, Thompson, Boulware & Feather

[57] ABSTRACT

There is disclosed a ram type blowout preventer with rams having ram front packings disposed within a recess extending across the front face of each ram body and including a seal strip of elastomeric material, metal plates above and below the strip of elastomeric material, and strips of non-elastomeric, relatively rigid material between the seal strip of elastomeric material and the top and bottom metal plates.

16 Claims, 3 Drawing Sheets

FIG. 5
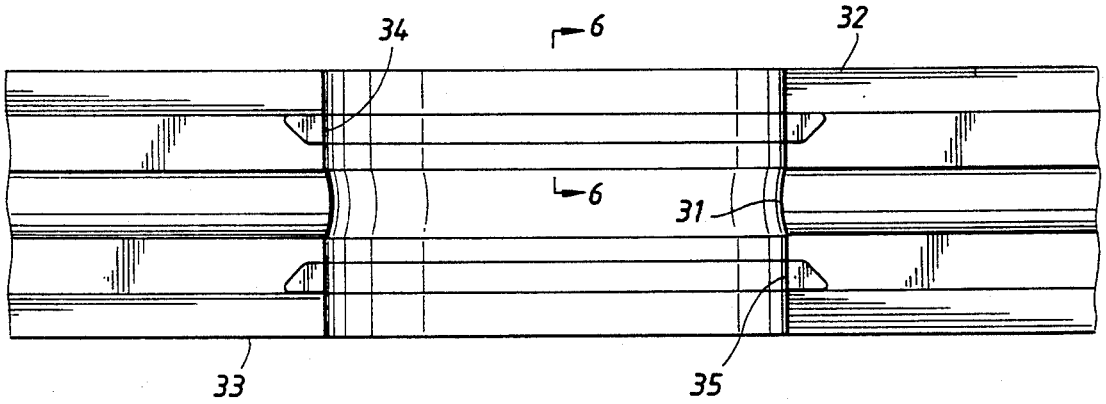
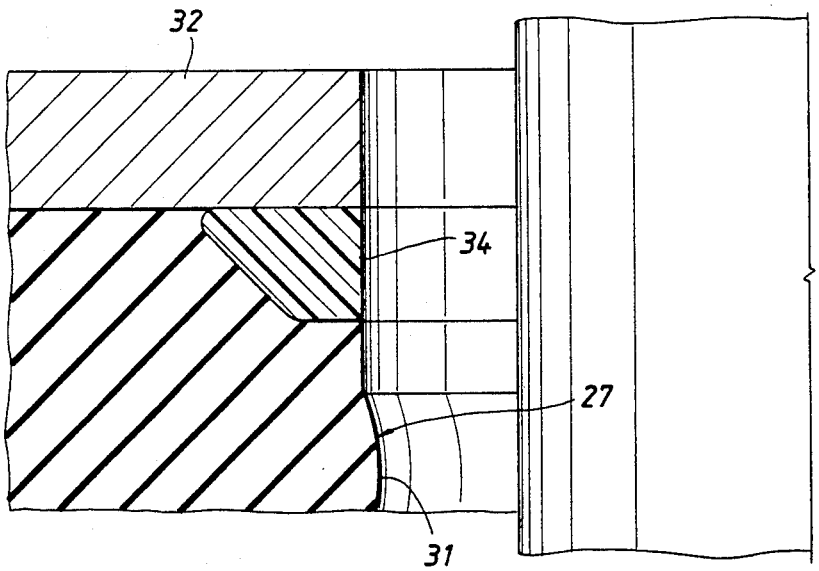
FIG. 6
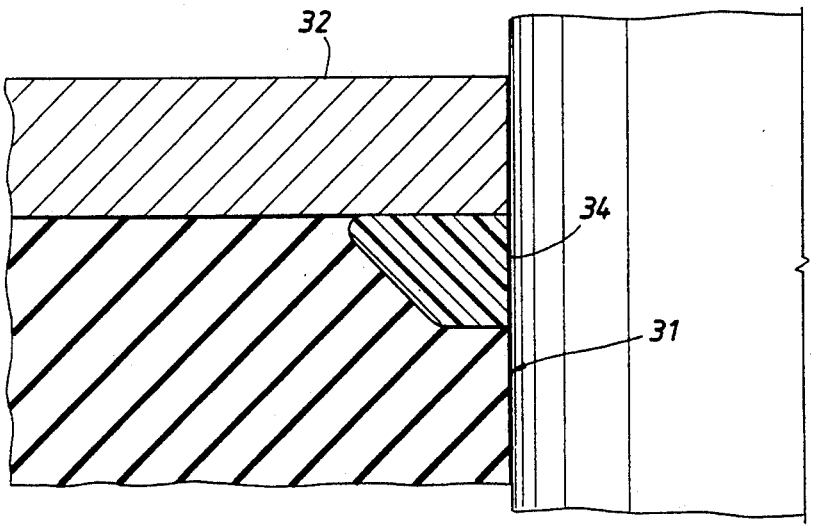
FIG. 7

RAM TYPE BLOWOUT PREVENTER HAVING IMPROVED RAM FRONT PACKINGS

This invention relates generally to ram type blowout preventers, and, more particularly, to improvements in the front packing for the rams of such preventers.

As well known in the art, blowout preventers comprise a body installed on the head of an oil or gas well and having guideways extending from opposite sides of a vertical bore which is adapted to receive a well pipe, and rams which are reciprocable within the guideways between positions opening and closing the bore. At least certain pairs of opposed rams have vertical recesses in their front ends which seal with respect to the pipe as well as one another and the preventer the body to close off the annular space between the pipe and the bore and thus contain well fluid beneath the rams.

Conventionally, each ram comprises a metal body guidably slidable in its guideway and packing carried on the front end, sides and over the top of the ram body. The rams are moved between opened and closed positions by hydraulic operators, which, when the rams are closed, force the front packings tightly against the pipe and one another with sufficient force to cause the packing to effect the desired seal.

The ram packing includes strips of rubber or other suitable elastomeric material received within recesses across the front end of the ram body and along the sides and over the top of the ram body so as to form a continuous seal. The ram front packing protrudes from recess in the front end of the ram body and initially contacts the pipe and the front packing of the other ram so as energize the side end top packings into sealing engagement with the preventer body. The rams also includes top and bottom metal plates which are received in the recess at the upper and lower sides of at least the front packing so as to prevent extrusion of the elastomeric material between the rams.

Although different pipes may be of the same nominal size, their outer diameters may vary because of manufacturing tolerances. Consequently, the pipe recesses formed in the front ends of the metal plates must be somewhat oversized and hence do not bridge the gap between them and the pipe. However, the rear ends of the plates are forced against portions of the seal strip behind them, as the front ends of the plates on opposite sides of the pipe are engaged and forced against one another, to extrude the front face of the seal strip against the pipe.

At elevated temperatures, the rubber or other elastomeric material from which the seal strips are normally made may not be able to contain the high pressure of the well fluid. Thus, such elastomeric materials exhibit a decrease in their mechanical properties, and, as a result, may soften to the point of being extruded between the pipe and front packings of the rams. On the other hand, if a tougher elastomeric material were used for these purposes, it might not be able to establish and maintain a seal at lower temperatures and pressures because it would not conform to the surface of the pipe.

Hence, it is the object of this invention to provide a blowout preventer ram of such construction as to form a reliable seal over a broad range of temperature and pressure conditions.

This and other objects are accomplished, in accordance with the illustrated and preferred object of the invention, by a preventer having rams whose front packing includes a strip of non-elastomeric, relatively rigid material disposed within the recess in the front end of the ram body intermediate the strip of rubber or other elastomeric material and the top metal plate. More particularly, the non-elastomeric strip has a vertical recess aligned with those in the elastomeric seal strip and metal plates, and, like the metal plates, is bonded to the elastomeric strip. However, the non-elastomeric strip is relatively slidable with respect to the top plate, so that, as the ram is moved inwardly to engage the pipe and opposed ram, the non-elastomeric strip is free to be extruded along with the elastomeric strip.

Under relatively low temperature conditions, it is anticipated that the elastomeric seal strip will form a good seal as if the non-elastomeric strip were not present. However, under high temperature conditions in which it might otherwise extrude between the upper plates, the elastomeric strip is contained by the non-elastomeric strip, which, although relatively rigid, is sufficiently deformable that it will fill the gap between the pipe and plate which the top plate would not fill.

In the preferred embodiment of the invention, the front packing includes another strip of non-elastomeric, relatively rigid material disposed within the recess between the strip of elastomeric material and the bottom plate. Like the lower non-elastomeric strip, this second strip has a vertical recess aligned with those of the other strips and slidable with respect to the lower bottom metal plate. Hence, this lower non-elastomeric strip functions similarly to the upper non-elastomeric strip in preventing extrusion of the elastomeric strip between the lower metal plates.

The non-elastomeric seal strip may be made of one of several different materials, such as a plastic material, or a hard rubber, preferably with reinforcement dispersed therein. Alternatively it may comprise horizontal layers of fibrous material in a matrix, or even a deformable metal. In any event, the material is tougher than the elastomeric seal strip, but less rigid and hence more deformable than the metal plates.

In the drawings wherein like reference characters are used throughout the designate like parts FIG. 1 is a view partly in vertical section and partly in elevation of a blowout preventer constructed in accordance with the present invention and with a well pipe extending through the bore thereof and the rams of the preventer withdrawn to open positions, FIG. 2 is a view similar to FIG. 1, but with the rams moved inwardly to closed position;

FIG. 5 is an enlarged view of the central portion of the ram packing as seen in FIG. 4;

FIG. 6 is further enlarged vertical sectional view of one of the front packings, as seen along broken line 6—6 of FIG. 5, and with the ram in the open position; and FIG. 7 is a view similar to FIG. 6, but with the ram in closed position.

Figure 1:
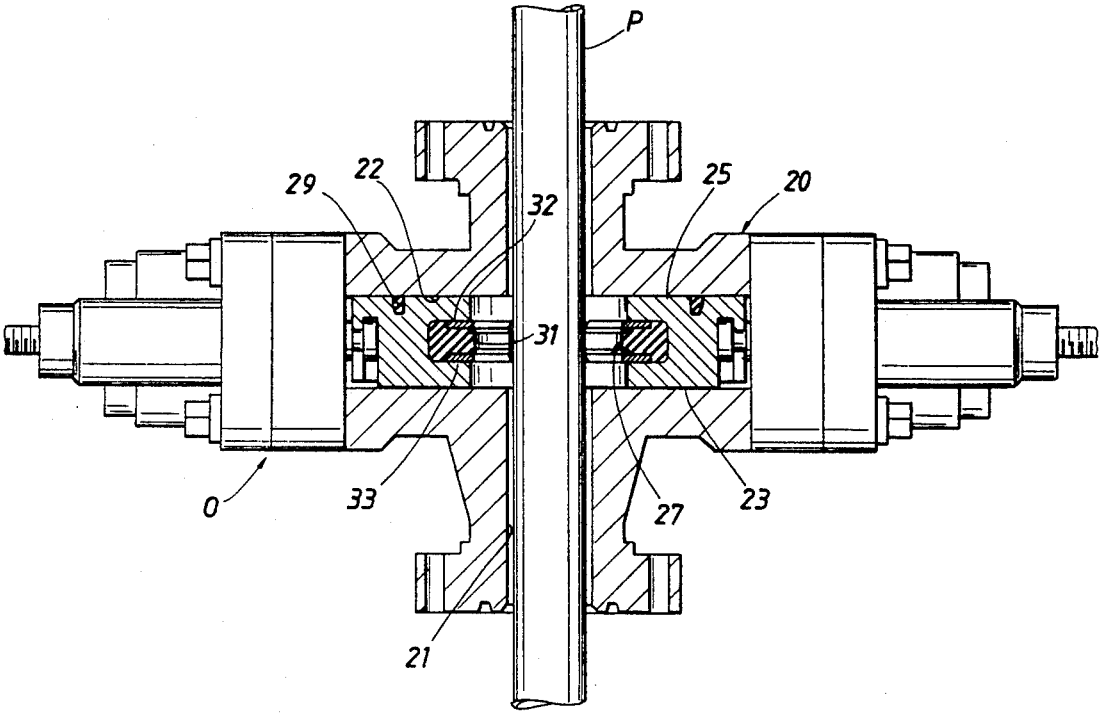
Figure 2:
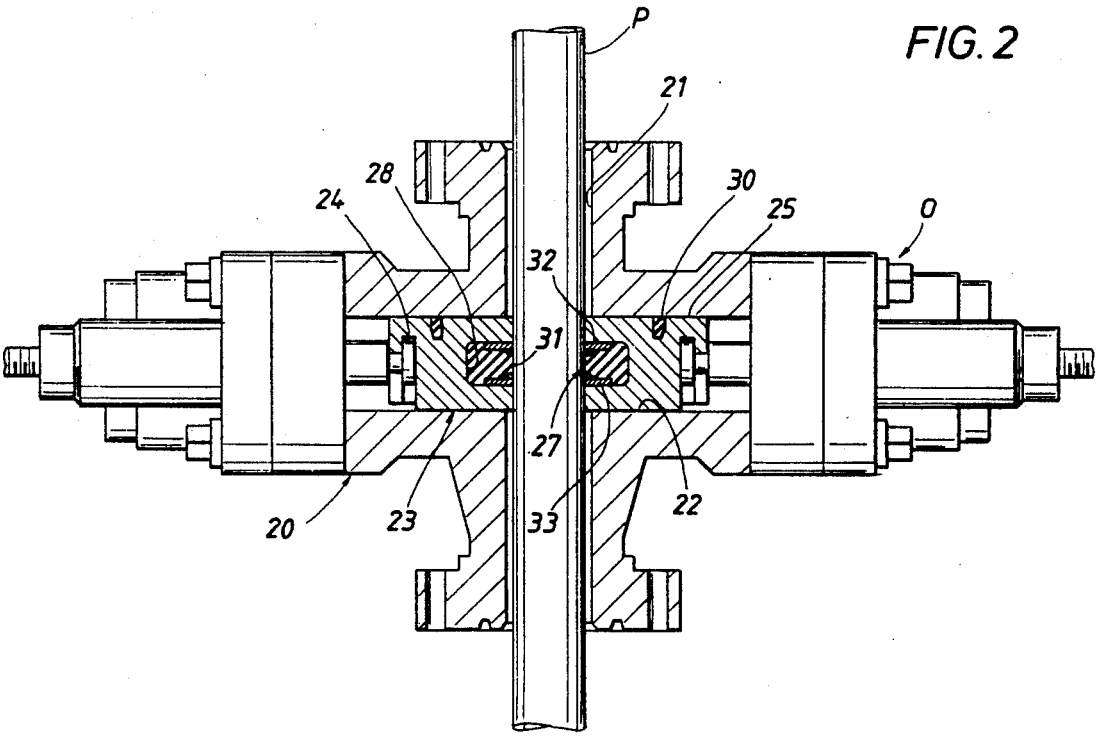

With reference now to the details of the above described drawings, the overall blowout preventer is shown in FIGS. 1 and 2 to comprise a housing 20 having a bore 21 extending vertically therethrough and guideways 22 extending horizontally outwardly from opposite sides of the bore. Flanges about the bore at the upper and lower ends of the preventer housing permit it to be installed at the head of a well, to receive a pipe P in the bore, which may be a drill pipe extending into the well.

The preventer further includes rams 23 each slidable within a guideway for movement between outer positions to open the bore, as shown in FIG. 1, and inner positions to close the bore, as shown in FIG. 2. The rams are moved between open and closed positions by operators O connected across the open outer ends of the guideways.

Each ram 23 comprises a metal ram body 25 closely slidable within a guideway 22 in the preventer housing, and having its outer end connected to the piston of the hydraulic operator by means of a part 24 on the inner end of the piston rod for movement with it. The ram further includes packing carried by the ram body across its front face as well as along its sides and over the top for sealably engaging not only with respect to the pipe P in the preventer housing bore, but also with respect to the opposing ram and the preventer housing including the guideways.

Figure 3:
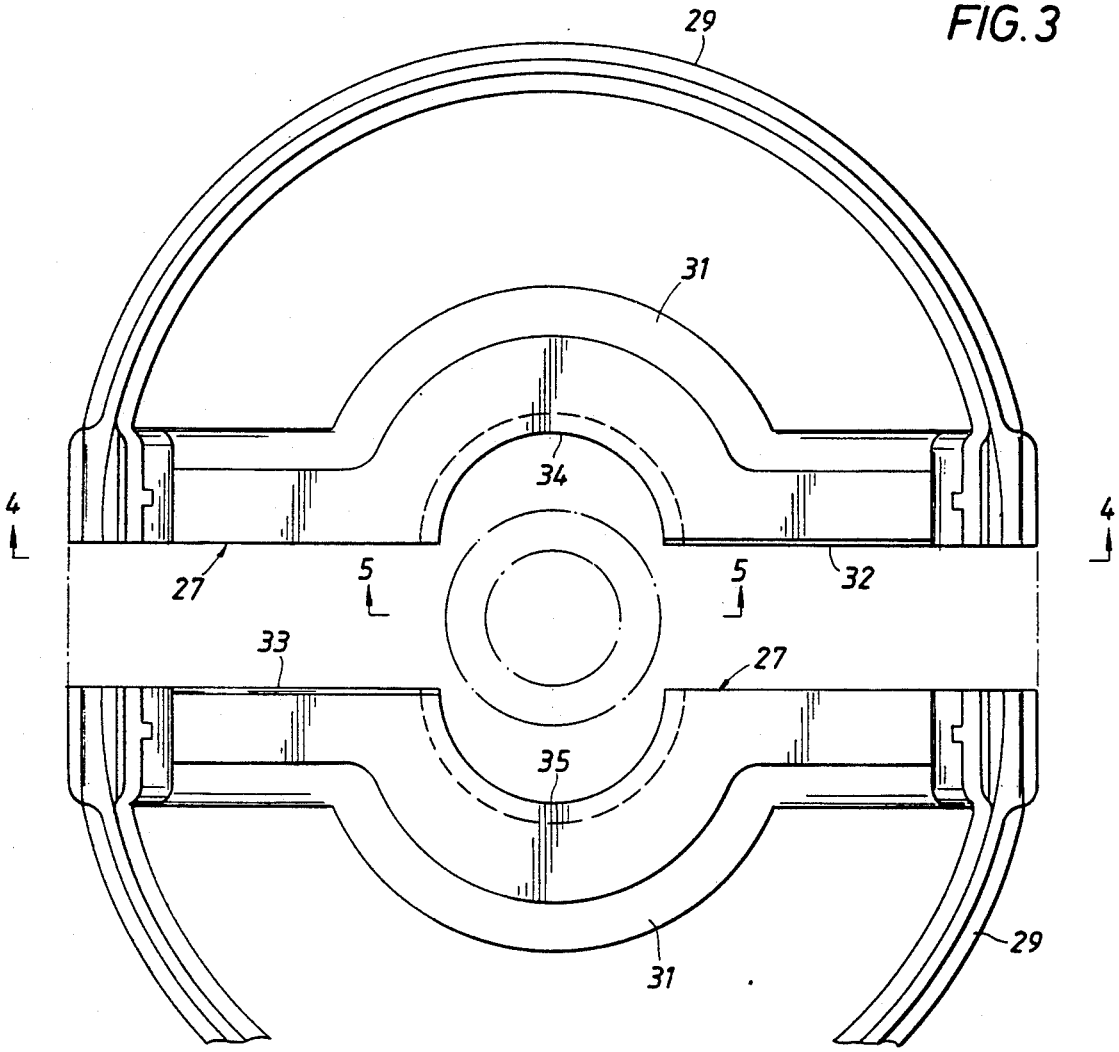
FIG. 3 is a top plan view of the packings of the rams removed from the ram bodies and spaced from one another.
Figure 4:
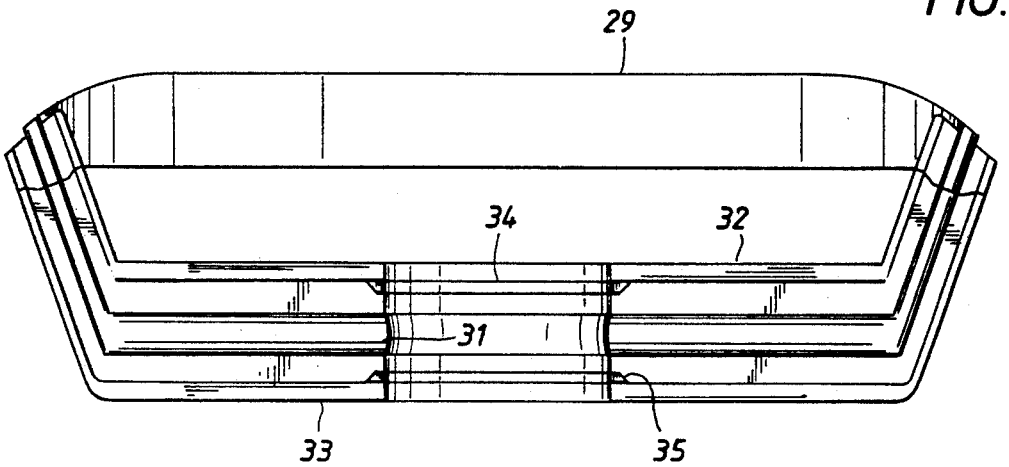
FIG. 4 is a front view of one of the ram packings, as seen along broken lines 4—4 of FIG. 3.

This packing, which is shown removed from the ram body in FIGS. 3 and 4, includes a front portion 27 disposed within a recess 28 across the front face of the ram body and a side and top portion 29 received within a recess 30 extending across the side and top of the ram body. More particularly, the recess 30 and the packing portion 29 received therein are of semi-circular shape to connect to their front ends with the opposite ends of the ram front packing.

Each ram front packing includes a strip 31 of rubber or other suitable elastomeric material received within the recess and extending laterally thereacross and then upwardly at its opposite ends for connection with the ends of the top packing 29. The ram front packing 27 also includes upper and lower plates 32 and 33 received in the recess above and below the seal strip 31. The front ends of the seal strip 31 and metal plates 32 protrude slightly from the front ends of the ram bodies on which they are carried. More particularly, and in accordance with the present invention, the ram front packing also includes strips 34 and 35 of non-elastomeric, relatively rigid material disposed respectively between the top of seal strip 31 and the bottom of metal plate 32 and between the bottom of seal strip 31 and the top of metal plate 33.

The front ends of each of the ram bodies and ram packings including the seal strip 27, 34 and 35 and the upper and lower plates 33 are provided with aligned vertical recesses intermediate their opposite sides. More particularly, the recesses are formed in the rams diametrically opposite one another and are of a size for fitting about the pipe P when the rams are moved to closed position, thus enabling the ram packing to seal not only with respect to that of the other ram and the blowout preventer housing, but also with respect to the pipe. As shown in FIGS. 3 and 4, the strips 34 and 35 do not extend all the way across the front packing, but only about the recess therein where the above-described problem is most acute. It is contemplated, however, that the strips 34 and 35 may extend to the sides of the front packing.

As previously described, the upper and lower plates 32 and 33 do not extend rearwardly all the way to the inner end of the recess 28. Thus, portions of the seal strip 31 are disposed behind the rear ends of the metal plates, so that, as the rams are moved inwardly to cause the inner ends of the metal plates to engage with one another, the inner ends of the seal strips are extruded outwardly to tightly engage one another and about the pipe. More particularly, the strips 34 and 35 are of even less radial extent so that portions of the seal strip 31 are also behind them so that they are extruded inwardly along with the seal strip 31 as the inner ends of the metal plates are forced against one another.

The strips 34 and 35, along with the metal plates, are bonded to the seal strip 31. However, the top strip 34 is free to slide with respect to the top plate 32, and the bottom strip 34 is free to slide with respect to the lower plate. Hence, as previously described, under high temperature conditions, the strips 34 and 35 will conform to the pipe and prevent the seal strip from extruded between their inner ends and the pipe, as might otherwise occur.

As previously mentioned, the strips are less elastic and more rigid than the elastomeric material of the seal strip 31 but nevertheless more deformable than the metal plates. The invention contemplates that they may be made of a variety of materials having these qualifications, including plastic material such as a polyether etherketone, preferably having reinforcement dispersed therein. Alternatively, the nonelastomeric strips may be made of layers of fibrous material in a matrix, or even a deformable metal such as copper.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blowout preventer, comprising a body having a vertical bore to receive a well pipe and opposed guideways extending from the bore, and rams reciprocable within the guideways for opening and closing the bore, each ram including a body slidably in a guideway, and means carried by the ram body for sealing with respect to the pipe and the opposed ram as well as with respect to the preventer body, when the rams are moved to closed position, said sealing means including a ram front packing received within a recess across the front face of the ram body and having a seal strip of elastomeric material, and a seal strip of non-elastomeric, relatively rigid material above the elastomeric seal strip, top and bottom metal plates respectively above and below the seal strips for preventing extrusion of the seal strips between the front ends of the ram bodies, the hardness of the non-elastic, relatively rigid material being intermediate that of the metal plates and elastomeric material, the front ends of the ram body, seal strips and metal plates having vertical recesses therein of essentially the same radius to fit about the pipe, the elastomeric seal strip including portions behind the metal plates, so that, upon engagement of the front ends of the plates with one another during closing movement of the rams, the front ends of the seal strips are urged tightly against one another and the pipe, and said non-elastomeric seal strip being free to slide with respect to the top metal plate.

2. As in claim 1, wherein the ram front packing also includes another seal strip of non-elastomeric, relatively rigid material intermediate the elastomeric seal strip and the bottom metal plate and free to slide with respect to the bottom metal plate in front of a portion of the elastomeric seal strip so that the front end of the bottom non-elastomeric seal strip is urged against the pipe along with the front ends of the other seal strips.

3. As in claim 1, wherein the non-elastomeric material is a plastic material.

4. As in claim 3, wherein reinforcement is dispersed within the plastic material.

5. As in claim 1, wherein the non-elastomeric material comprises horizontal layers of fibrous material in a matrix.

6. As in claim 1, wherein the non-elastomeric material is a deformable metal.

7. A blowout prevent ram, comprising a ram body guidably slidable in a guideway of the body of a blowout preventer which extends from a vertical bore in the body which is adapted to receive a well pipe, and means carried by the ram body for sealing with respect to the pipe and a ram in an opposed guideway as well as with respect to the preventer body, when the opposed rams are moved inwardly to close the bore, said sealing means including a ram front packing received within a recess across the front face of the ram body and having a seal strip of elastomeric material, seal strips of non-elastomeric, relatively rigid material above and below the elastomeric seal strip, and top and bottom metal plates respectively above and below the seal strips for preventing extrusion of the seal strips between the front ends of the ram bodies, the front ends of the ram body, seal strips and metal plates having vertical recesses therein to fit about the pipe, the elastomeric seal strip including portions behind the rear ends of the non-elastomeric seal strip and metal plates, so that, upon engagement of the opposed front ends of the plates with one another during inward movement of the rams, the front ends of the seal strips are urged tightly against one another and the pipe, and said non-elastomeric seal strips being free to slide with respect to the metal plates.

8. As in claim 7, wherein the non-elastomeric material is a plastic material.

9. As in claim 8, wherein reinforcement is dispersed within the plastic material.

10. As in claim 7, wherein the non-elastomeric material comprises horizontal layers of fibrous material in a matrix.

11. As in claim 7, wherein the non-elastomeric material is a deformable metal.

12. For use in a blowout preventer ram having a body guidably slidable in a guideway of the body of a blowout preventer which extends from a bore for receiving a well pipe, across the front face of the ram body, a ram front packing disposable within a recess across the front face of the ram body and comprising a seal strip of elastomeric material, seal strips of non-elastomeric, relatively rigid material above and below the elastomeric seal strip, and top and bottom metal plates respectively above and below the seal strips for preventing extrusion of the seal strips between the front ends of the ram bodies, the front ends of the seal strips and metal plates having vertical recesses therein to fit about the pipe, the elastomeric seal strip including portions behind the rear ends of the non-elastomeric seal strip and metal plates, so that, upon engagement of the opposed front ends of the plates with one another during inward movement of the opposed rams, the front ends of the seal strips are urged tightly against one another and the pipe, and said non-elastomeric seal strips being free to slide with respect to the metal plates.

13. As in claim 12, wherein the non-elastomeric material is a plastic material.

14. As in claim 13, wherein reinforcement is dispersed within the plastic

15. As in claim 13, wherein the non-elastomeric material comprises horizontal layers of fibrous material in a matrix.

16. As in claim 13, wherein the non-elastomeric material is a deformable metal.

* * * * *